US006820941B2

(12) United States Patent
Vankov et al.

(10) Patent No.: US 6,820,941 B2
(45) Date of Patent: Nov. 23, 2004

(54) CLAMPING DEVICES

(75) Inventors: Michael Vankov, Schmitten (DE); Bernd Stein, Schmitten (DE); Christian Stief, Frankfurt am Main (DE); Michael Machlitt, Schwalbach (DE); Uwe Tretrop, Oberursel (DE)

(73) Assignee: Braun GmbH (DE)

( * ) Notice: Subject to any disclaimer, the term of this patent is extended or adjusted under 35 U.S.C. 154(b) by 114 days.

(21) Appl. No.: 10/371,368

(22) Filed: Feb. 19, 2003

(65) Prior Publication Data

US 2003/0155802 A1 Aug. 21, 2003

(30) Foreign Application Priority Data

Feb. 20, 2002 (DE) ..... 102 07 019

(51) Int. Cl.[7] ..... A46D 3/00; A46D 3/04; A46D 3/08

(52) U.S. Cl. ..... 300/2; 300/21; 300/5

(58) Field of Search ..... 300/2, 4–5, 7, 300/21; 24/335, 467, 584.1; 29/559; 269/272, 287

(56) References Cited

U.S. PATENT DOCUMENTS

| | | | | |
|---|---|---|---|---|
| 3,408,112 A | * | 10/1968 | Piotrowski | 300/21 |
| 4,635,313 A | * | 1/1987 | Fassler et al. | 15/193 |
| 4,979,782 A | | 12/1990 | Weihrauch | |
| 5,622,411 A | | 4/1997 | Weihrauch | |

FOREIGN PATENT DOCUMENTS

| | | |
|---|---|---|
| DE | 40 06 325 A1 | 9/1991 |
| EP | 0 674 862 A1 | 3/1995 |
| EP | 0 567 672 B1 | 9/1995 |
| WO | WO 99/22623 | 5/1999 |
| WO | WO 01/15569 | 8/2000 |

* cited by examiner

*Primary Examiner*—Robert J. Warden, Sr.
*Assistant Examiner*—Laura C Cole
(74) *Attorney, Agent, or Firm*—Fish & Richardson P.C.

(57) ABSTRACT

A clamping device for restraining filament tufts in a bristle cluster includes fixed and movable clamping plates. The clamping plates have apertures that are aligned in the unloaded position and that are offset relative to each other in the loaded position. The movable clamping plates can be displaced relative to the fixed clamping plates, and each movable clamping plate secures a specific portion of the bristle cluster.

13 Claims, 3 Drawing Sheets

CLAMPING DEVICES

CROSS REFERENCE TO RELATED APPLICATION

This application claims priority to German Patent Application No. DE 102 07 019.9, filed Feb. 20, 2002, which is incorporated herein by reference in its entirety.

TECHNICAL FIELD

The invention relates to a device and a method for securing filament tufts.

BACKGROUND

Many clamping methods and devices are known.

For example, U.S. Pat. No. 4,979,782 describes a method and a device for producing bristle products from plastic. In that case, the bristle products include a bristle carrier and bristles. Each bristle is secured at one end to the bristle side surface of the bristle carrier. At their other ends (the "operating ends"), the bristles are uniformly rounded. During production of such bristle products, the bristles are clamped in a clamping device while the operating ends are in a flat plane. Thereafter, the bristles' operating ends are uniformly rounded while they are clamped in the flat plane. The clamp restraining the bristles is then loosened and the operating ends of the bristles are axially displaced relative to one another. In this way, the desired outer bristle contour is achieved.

German Patent No. DE 40 06 325 A1 describes a method for finishing the bristles of a brush. The bristles are clamped at a distance from their operating ends and are cut to the desired length. Then, the bristles are finished using a flat abrasive surface arranged perpendicularly to the alignment of the bristles. The bristles are moved along the abrasive surface's circular tracks, all of which have the same diameter. To adjust contact pressure, the abrasive surface is moved towards the bristles. To influence the results of finishing, the bristles are restrained laterally by the abrasive surface at a distance between their clamped ends and their operating ends. This distance is adjustable, but is always the same for all bristles.

European Patent No. EP 0 567 672 B1 describes a method for producing toothbrushes with specially profiled bristle tufts inserted in their brush heads. In this method, the final finishing step of cutting and rounding the bristle tufts' operating ends may be omitted if the filaments to be used are already rounded. The tufts are inserted into through-holes in a clamping device before being affixed to the bristle carrier. The clamping device's through-holes form a pattern matching that formed by the bristle carrier's holes. Each through-hole in the clamping device is connected to a clamping member. The bristles' ends protrude from both sides of the clamping device. While the clamp elements of the clamping device are in the loosened state, a pressure element with a shaped side is moved forward to engage the protruding ends of the bristles. The pressure element presses the bristles axially into the through-holes. In this way, both ends of the bristles are aligned in parallel surfaces, the configuration of which matches shaped sides. Then the clamp elements are used to restrain the bristles in the clamping frame while the ends are aligned. The base ends of the bristles are then inserted into the holes in the bristle carrier.

Finally, WO 01/91607 A2 describes a clamping device for restraining filament tufts of varying sizes in which a movable clamp element is moved between two fixed clamp elements. The filament tufts then pass through apertures in the clamp elements. In the unloaded state, the apertures are aligned.

One problem with known transportation methods in "spool feeding installations" (i.e., brush manufacturing machines in which the bristle material is provided on rolls) arises from the nature of the tufts. Considerable variations in the circumference and diameter of the tufts are unavoidable, since the tufts are produced from individual filaments. In known clamping techniques, the largest tuft determines the highest possible clamping force. Compressing the tufts further causes damage to the filaments. As a consequence, smaller tufts may not be securely clamped and thus may slip out of the clamping apparatus. This problem is exacerbated by the fact that compressibility also varies with the size of the tufts.

SUMMARY

In one aspect, the invention features a clamping device including a first clamp element and a second clamp element. The clamp elements comprise clamping plates, and the clamp elements are movable with respect to each other. The clamping plates define an array of apertures, such that the clamping plates can clamp one portion of one filament tuft, while not clamping another portion of the same tuft or another different filament tuft. The clamping device can accommodate tufts of different sizes. As a result, the clamping pressure exerted on each of the various bristle tufts may be optimized for the individual bristle cluster segments formed by the tufts. One advantage to such an arrangement is that it prevents the dislodging of tufts that are too small to be restrained effectively. Another advantage is the avoidance of clamping larger tufts too tightly. Thus, the likelihood of inflicting damage upon larger tufts' filaments, or of accidentally cutting them, decreases. In a brush manufacturing machine, multiple clamping devices may be deployed one behind the other or side-by-side. Such a clamping device is particularly advantageous for brush manufacturing machines in which the bristle material is provided on rolls, also known as "spool feeding installations".

In some embodiments, the clamping plates of a clamp element may be arranged in multiple planes, one behind the other, in the direction of the filament tuft. In some embodiments, the clamping plates of a clamp element may include narrow apertures. In some such embodiments, only the narrow apertures exert a clamping force on the filament tufts being passed therethrough, while the filament tufts that are fed through the wide apertures are not clamped. Consequently, each clamping plate clamps only a portion, that is to say only a specific segment, of the complete bristle cluster. All portions taken together then form the complete bristle cluster.

In some embodiments, the clamping plates of a clamp element may be arranged in one plane and parallel to one another in the longitudinal direction of the filament. For example, the clamping plates may move toward, and slide over, one another. Each clamping plate clamps only a portion of the complete bristle cluster. All portions taken together then form the complete bristle cluster. In some such embodiments, only filament tufts that are actually being restrained by a clamping plate also pass through the respective clamping plate.

Some embodiments include multiple clamping plates. By dividing the clamping force among a plurality of clamping plates, it is possible to precisely synchronize the clamping forces acting on the filament tufts. In addition, complicated bristle clusters with the most disparate tuft sizes may be clamped with consistently high-quality results.

In some embodiments, the clamping device includes at least one contact pressure plate for exerting a force on the clamping plates of a clamp element. In some such embodiments, it is possible to apply a load to a specific point of the clamping device (for example, with pneumatic pressure). Alternatively, pressure may be applied by electromagnetic or hydraulic means, though the latter is not so suitable due to the risk of oil leaks and the lower operating speed. In some embodiments, multiple contact pressure plates may be provided, one for each clamping plate of a clamp element. Each clamping plate of a clamp element may then be regulated individually and separately from the others.

In some embodiments, the clamping plates of a clamp element may be subjected to pressure via dampers. For example, metal or plastic compression springs or components made from elastomeric plastic may be used as dampers. This enables apportioned, damped transmission of the centrally generated compressive force to the respective clamping plates. Moreover, the dampers assist in returning the contact pressure plate as soon as the applied compressive force is dissipated.

In another aspect, the invention features a method for restraining filament tufts using a clamping device with fixed and movable clamping plates. The clamping device has at least two movable clamping plates. Filament tufts having varying tuft sizes are fed from a spool feeding installation into the clamping device. The supplied material may, for example, be unwound from one or more spools. The filament tufts are clamped using the necessary clamping force for each tuft size by moving the clamping plates of a clamp element relative to the clamping plates of another clamp element. At least two segments are created in the bristle cluster formed by the filament tufts. In this way, the clamping force is defined both by the tuft size and the maximum permissible clamping force to avoid damaging the filament tufts. An optional finishing step may be performed, and then the filament tufts are transferred, and the clamping plates are released.

In some embodiments, the bristle tufts may already be arranged in a desired bristle cluster form, for example on the brush head of a toothbrush. All process steps are fully automatic and are executed at high speed. By dividing the filament tuft that is grasped by the clamping device into two or more segments, a reliable process is enabled that assures consistently high product quality. It is also advantageous that the clamping device include as many segments as possible for accommodating complicated bristle clusters.

In some embodiments, the method includes an additional step of adapting the compressive force via the dampers to match the respective tuft size in the individual segments. The dampers may be compression springs, for example, and may be made from metal, plastic, or elastic components made from rubber. In addition to the adjustment of the compressive force on the contact pressure plate, a further adjustment capability is the selection of the desired elastic resiliency.

In some embodiments, the method includes rounding and/or cutting the filament tufts to size as a finishing step. Other finishing steps, multiple finishing steps or even no finishing steps are possible.

Implementations of the invention may have one or more of the following advantages. The incidence of filament tufts slipping out of the filament feed device because of inadequate clamping force due to varying tuft sizes may be eliminated. The range of variation in the individual filament tuft diameters may be reduced. Damage to filaments as a result of excessive clamping force may be effectively eradicated.

The details of one or more embodiments of the invention are set forth in the accompanying drawings and the description below. Other features and advantages of the invention will be apparent from the description and drawings, and from the claims.

DETAILED DESCRIPTION

Figure 1A:
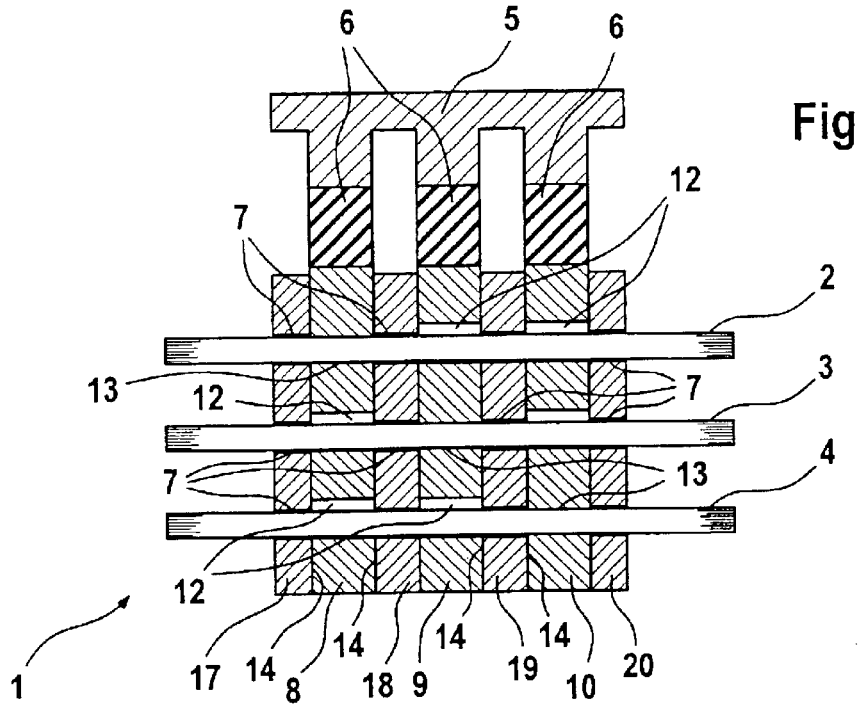
FIG. 1*a* is a schematic cross-sectional view of one embodiment of a clamping device, in an unloaded condition.
Figure 1B:
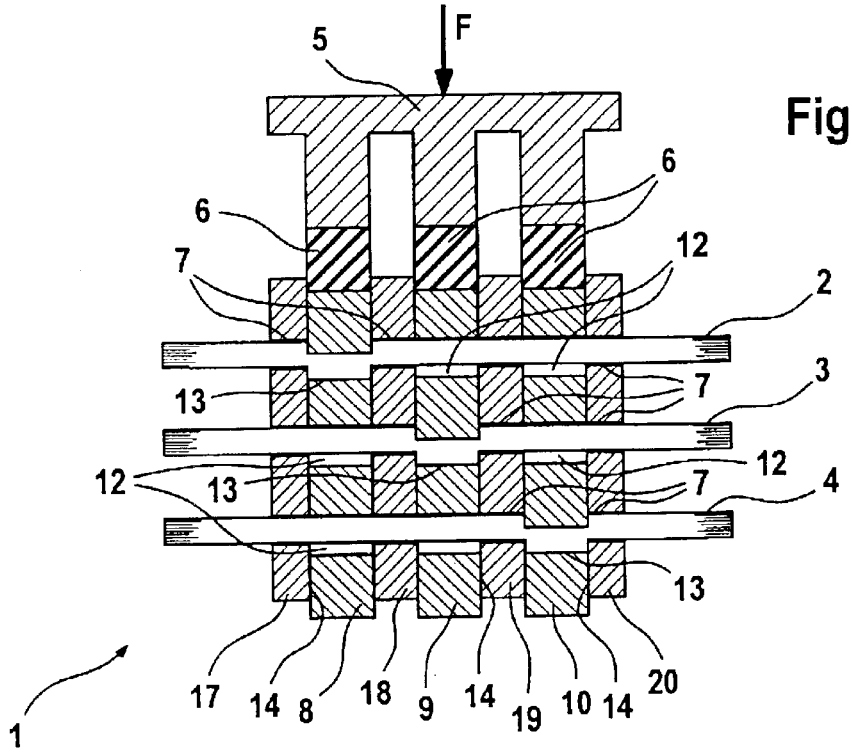
FIG. 1*b* is a schematic cross-sectional view of the embodiment of FIG. 1*a*, in a loaded condition.
Figure 2A:
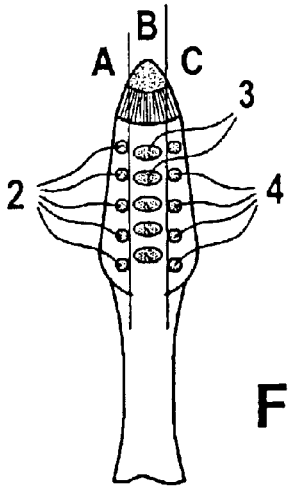
FIGS. 2*a* and 2*b* are a schematic representation of a bristle cluster produced using the clamping device of FIGS. 1*a* and 1*b*.
Figure 2B:
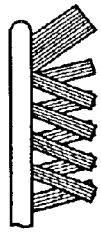

Referring to FIGS. 1*a* and 1*b*, a clamping device 1 includes a plurality of fixed clamping plates 17, 18, 19, and 20, that are arranged one behind the other in the longitudinal direction of filament tufts 2, 3, and 4. Clamping plates 17, 18, 19, and 20 together form a first clamp element. Movable clamping plates 8, 9, and 10 are arranged one behind the other in multiple planes. Together, movable clamping plates 8, 9, and 10 form a second clamp element. Fixed clamping plates 17, 18, 19, and 20 are each furnished with apertures 7 to accommodate first filament tuft 2, second filament tuft 3, and third filament tuft 4. The filament tufts are made from polymer plastic fibers. Apertures 7 are arranged in fixed clamping plates 17, 18, 19, and 20 so as to produce a desired bristle cluster on a toothbrush head, as shown in FIGS. 2*a* and 2*b*.

A first movable clamping plate 8, second movable clamping plate 9, and third movable clamping plate 10 are arranged one behind the other in fixed clamping plates 17, 18, 19, and 20, and perpendicular to horizontal apertures 7. The movable clamping plates are also perpendicular to the longitudinal axis of first filament tuft 2, second filament tuft 3, and third filament tuft 4. Movable clamping plates 8, 9, and 10 are, e.g., rectangular metal plates. First movable clamping plate 8, second movable clamping plate 9, and third movable clamping plate 10 are arranged one behind the other in the spaces that serve as guide surfaces between fixed clamping plates 17, 18, 19, and 20, and may be displaced lengthwise.

Movable clamping plates 8, 9, and 10 are each furnished with a damper 6, which can be made from, e.g., elastomer plastic. Referring to FIGS. 1*a* and 1*b*, dampers 6 are each arranged at the top ends of movable clamping plates 8, 9, and 10. Dampers 6 protrude above the top edges of fixed clamping plates 17, 18, 19, and 20. In FIGS. 1*a* and 1*b*, dampers 6 provide the connection to contact pressure plate 5.

In some embodiments, contact pressure plate 5 is made from the same material as movable clamping plates 8, 9, and 10, i.e. from machined metal. Contact pressure plate 5 is an essentially rectangular surface that is placed under compressive load by a pneumatic piston (not shown). On its underside, contact pressure plate 5 has projections that extend backward relative to the plane of the drawing and that are connected to spring dampers 6.

In addition, in FIGS. 1*a* and 1*b*, first movable clamping plate 8, second movable clamping plate 9, and third movable clamping plate 10 each have two wide horizontal apertures 12 and two narrow horizontal apertures 13. When clamping device 1 is in the unloaded state, as shown in FIG. 1*a*, apertures 7 in fixed clamping plates 17, 18, 19, and 20 are disposed flush with apertures 12 and 13 of movable clamping plates 8, 9, and 10. Apertures 12 and 13 are the same size as, or larger than, apertures 7. Narrow aperture 13 of first movable clamping plate 8 is provided for first filament tuft 2. Narrow aperture 13 of second movable clamping plate 9 is provided for second filament tuft 3. Finally, narrow aperture 13 of third movable clamping plate 10 is provided for third filament tuft 4.

If a force is applied to contact pressure plate 5 of clamping device 1 in the direction of arrow F, as shown in FIG. 1*b*, then first movable clamping plate 8, second movable clamping plate 9, and third movable clamping plate 10 are displaced in the direction of arrow F in the drawing, i.e. downward.

With the vertical displacement of first movable clamping plate 8, first filament tuft 2, which is fed through narrow aperture 13 of first movable clamping plate 8, is also displaced downward, and clamped. At the same time, damper 6, which is disposed between first movable clamping plate 8 and contact pressure plate 5, is compressed by the resistive counter-pressure of filament tuft 2. Second filament tuft 3 and third filament tuft 4, which are also fed through first movable clamping plate 8, are not affected by the vertical displacement of first movable clamping plate 8, since they each pass through wide apertures 12, the diameters of which are at least as large as the maximum displacement travel of first movable clamping plate 8.

With the vertical displacement of second movable clamping plate 9, second filament tuft 3, which is fed through narrow aperture 13 of second movable clamping plate 9, is downwardly displaced and clamped. At the same time, elastomer damper 6, which is disposed between second movable clamping plate 9 and contact pressure plate 5, is compressed by the resistive counter-pressure of filament tuft 3. Although first and third filament tufts 2 and 4 also are fed through second movable clamping plate 9, they are not affected by the vertical displacement of second movable clamping plate 9. Tufts 2 and 4 are not affected because they each pass through wide apertures 12, the diameters of which are selected so that even the maximum displacement of second movable clamping plate 9 does not bring it into contact with either of first and third filament tufts 2 and 4.

Third movable clamping plate 10 functions similarly to first movable clamping plate 8 and second movable clamping plate 9. While third filament tuft 4 is clamped, first filament tuft 2 and second filament tuft 3 are not clamped because of wide apertures 12 in third movable clamping plate 10. As shown in FIG. 1*b*, when filament tufts 2, 3, and 4 are clamped, movable clamping plates 8, 9, and 10 project downward below fixed clamping plates 17, 18, 19, and 20, so that movable clamping plates 8, 9, and 10 are outside guide surfaces 14.

Although FIG. 1*b* may leave the impression that filament tufts 2, 3, and 4 have been cut by clamping plates 8, 9, and 10, this is not the case. The exaggerated representation of the displacement of clamping plates 8, 9, and 10 is intended to show that they are moved perpendicularly to stationary apertures 7 at this point and that filament tufts 2, 3, and 4 are clamped therein. In reality, the displacement of clamping plates 8, 9, and 10 is in the order of a few hundredths of a millimeter. In other words, apertures 13 are offset relative to apertures 7 by only a few hundredths of a millimeter. Such an offset distance is sufficient to allow the tufts to be clamped.

In the clamped condition, the protruding ends of filament tufts 2, 3, and 4 that project in clamping device 1 beyond the outer fixed clamping plates 17 and 20 may be worked as desired. For example, the protruding ends may be rounded, cut to length, or melted. When the processing step is complete, the bristle cluster may the be transferred to a second magazine. Clamping device 1 is released, meaning that movable clamping plates 8, 9, and 10 are returned to their starting positions and the clamping force on filament tufts 2, 3, and 4 is thereby lifted. For the embodiment of FIGS. 1*a* and 1*b*, the load is removed from clamping device 1 by the withdrawal of contact pressure plate 5.

In some cases, the filament tufts have varying thicknesses, or special filaments with differing thicknesses and/or elasticities are used in filament tufts 2, 3, and 4. In such cases, movable clamping plates 8, 9, and 10 may cause variable spring deflection in dampers 6 and variable drifting of movable clamping plates 8, 9, and 10. The three movable clamping plates 8, 9, and 10 are thus movable independently of one another. Furthermore, their aperture geometry causes them to each influence a different part of the bristle cluster, which translates to a division into three segments in the embodiment shown.

FIGS. 2*a* and 2*b* also show (schematically) the division of the bristle cluster into segments. In FIGS. 2*a* and 2*b*, a bristle cluster is shown that has been divided into three segments A, B, and C. Such a bristle cluster may be produced for example by the clamping device 1 of FIGS. 1*a* and 1*b*.

Figure 3B:
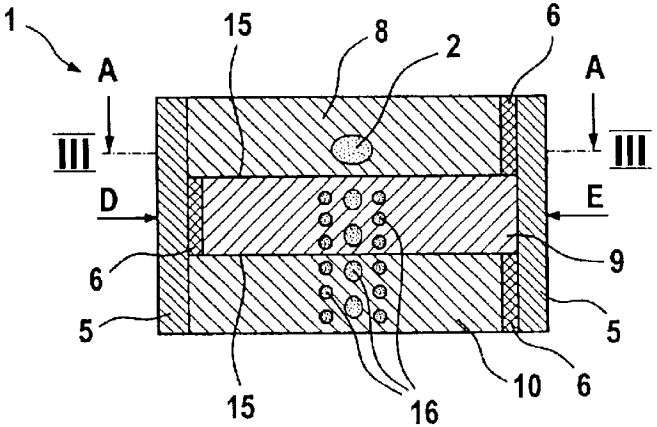
FIGS. 3*a* and 3*b* are a schematic cross-sectional view of a second embodiment of a clamping device.
Figure 3A:
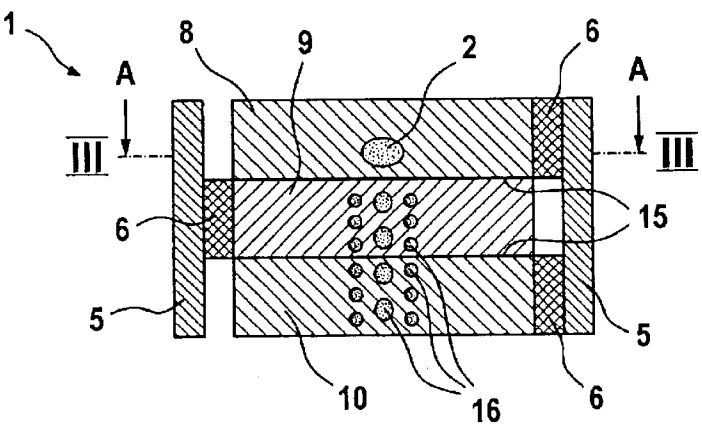

FIGS. 3*a* and 3*b* show a cross-sectional view of another embodiment of a clamping device 1 for restraining filament tufts 2 and 16. Clamping device 1 includes a first movable clamping plate 8, a second movable clamping plate 9, and a third movable clamping plate 10 which are arranged to move in a horizontal direction according to the drawing. The three movable clamping plates 8, 9, and 10 slide directly over one another on sliding surfaces 15. That is, the three movable clamping plates 8, 9, and 10 are arranged in one plane and parallel to one another in the longitudinal direction of the filaments. The bristle cluster is divided into three segments by clamping device 1.

The three movable clamping plates 8, 9, and 10 are each furnished with a damper 6 on one side. Dampers 6, which can be made from, e.g., elastomer plastic, are connected at the ends thereof closest to movable clamping plates 8, 9, and 10 to contact pressure plate 5. Contact pressure plate 5 has a vertical orientation. In other words, contact pressure plate 5 is perpendicular to dampers 6. Contact pressure plate 5 is made from machined metal.

When clamping device 1 is in the loaded condition, as shown in FIG. 3*b*, the pressure applied by clamping device 1 on contact pressure plates 5 causes movable clamping plates 8 and 10 to be moved in the direction indicated by arrow E, while movable clamping plate 9 is moved in the direction indicated by arrow D. The top first movable clamping plate 8 and the bottom third movable clamping plate 10 move parallel to each other in the direction of arrow E. The middle second movable clamping plate 9 moves in the opposite direction, in the direction of arrow D. As more compressive force is applied to dampers 6, the corresponding spring resistance increases. Additionally, in the clamping device 1 of FIG. 3*a*, non-homogeneous filament tuft thickness or the introduction of special filaments with differing thicknesses and/or elasticities may cause dampers 6 to present differing spring deflection (not shown).

Figure 4B:
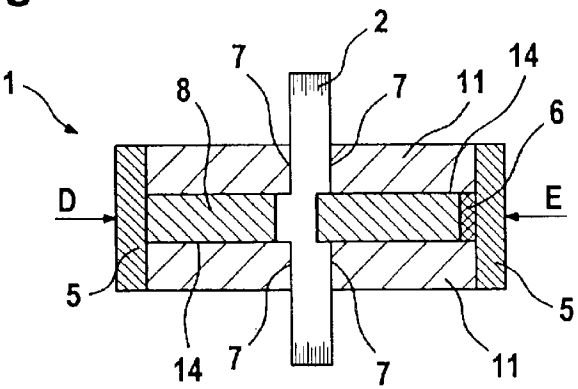
FIGS. 4*a* and 4*b* are a schematic cross-sectional view in the direction of arrow A along line III—III in the clamping device of FIGS. 3*a* and 3*b*.
Figure 4A:
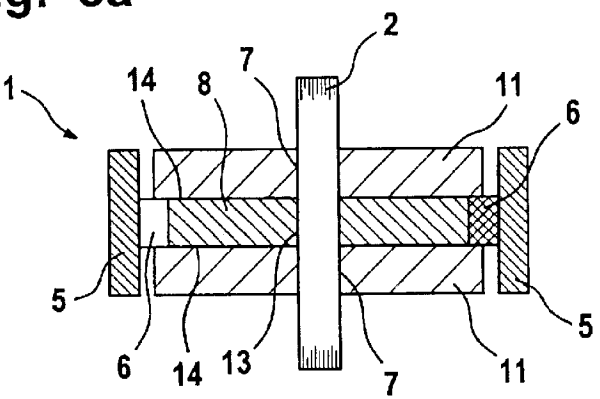

FIGS. 4*a* and 4*b* show cross-sectional views of FIGS. 3*a* and 3*b* in the direction of arrow A along line III—III. In FIGS. 4*a* and 4*b*, fixed clamping plates 11, between which movable clamping plates 8, 9, and 10 are movably disposed, are visible. Fixed clamping plates 11 include apertures 7 for receiving filament tufts 2 and 16.

When contact pressure plate 5 is moved in the direction of arrow E (see FIG. 4*b*), first movable clamping plate 8 is displaced to the left and spring damper 6 is compressed. First filament tuft 2 is clamped thereby and may, for example, be worked according to needs. The same applies for filament tuft 16, which is not visible in FIGS. 4*a* and 4*b*.

Figure 5:
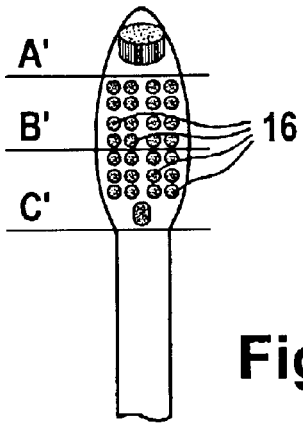
FIG. 5 is a schematic representation of a bristle cluster produced using a clamping device as represented in FIGS. 3*a* and 3*b*.

The clamped bristle cluster may be cut to length, finished and transferred to an intermediate magazine. Clamping with three movable clamping plates 8, 9, and 10 allows the bristle cluster to be divided into three segments as shown, for example, in FIG. 5. In FIG. 5, the bristle cluster has three segments A', B', and C'. Filament tufts of differing tuft lengths are prevented from slipping out in an undesirable manner, as illustrated in FIG. 5 for first filament tuft 2 and filament tufts 16. This division into segments further also prevents damage to, or incorrect cutting of, filament tufts 2 and 16.

What is claimed is:

1. A clamping device for holding a plurality of discrete tufts of filaments in a bristle cluster, the device comprising:

first and second clamp elements movable with respect to each other between a loaded and an unloaded position, each of the first and second clamp elements comprising a plurality of clamping plates defining an array of apertures therethrough, each clamping plate of the second clamp element being disposed between adjacent clamping plates of the first clamp element, the apertures of the first clamp element being arranged to align with the apertures of the second clamp element when the clamping device is in the unloaded position, thereby forming tuft channels, and offset relative to each other when the clamping device is in the loaded position, to secure the bristle tufts in the device by applying a transverse load to each tuft, wherein the apertures of the clamping plates of the second clamp element are configured such that, in the loaded position, each clamping plate of the second clamp element secures only selected tufts, while other tufts extending unclamped through that clamping plate are secured by another of the clamping plates of the second clamp element.

2. The clamping device of claim 1, wherein the clamping plates have flat surfaces.

3. The clamping device of claim 1, wherein the clamping plates of the second clamp element are arranged in multiple planes, one behind the other, in the longitudinal direction of a filament tuft.

4. The clamping device of claim 3, wherein each of the clamping plates of the second clamp element defines at least one aperture that is wider than the corresponding tuft channel.

5. The clamping device of claim 1, wherein the clamping plates of the second clamp element are disposed in one plane and are parallel to each other in the longitudinal direction of a filament.

6. The clamping device of claim 1, wherein the second clamp element comprises more than two clamping plates.

7. The clamping device of claim 6, wherein the second clamp element comprises three clamping plates.

8. The clamping device of claim 1, further comprising at least one contact pressure plate through which a force may be exerted on the clamping plates of the second clamp element.

9. The clamping device of claim 1, further comprising dampers.

10. A method for securing filament tufts using the clamping device of claim 1, comprising:

(a) feeding filament tufts of varying tuft sizes form a spool feeding installation into the clamping device of claim 1;

(b) clamping the filament tufts with a force selected for each tuft size by moving the clamping plates of the second clamp element relative to the clamping plates of the first clamp element, thereby forming at least two segments in the bristle cluster formed by the filament tufts; and (c) removing the filament tufts from the clamping device by releasing the clamping plates.

11. The method of claim 10, further comprising a finishing step which occurs after the clamping step and before the removing step.

12. The method of claim 11, wherein the finishing step comprises rounding and/or cutting the filament tufts to size.

13. The method of claim 10, further comprising adapting the compressive force via the dampers to match the respective filament tuft size.

* * * * *

UNITED STATES PATENT AND TRADEMARK OFFICE

CERTIFICATE OF CORRECTION

PATENT NO. : 6,820,941 B2
DATED : November 23, 2004
INVENTOR(S) : Michael Vankov et al.

It is certified that error appears in the above-identified patent and that said Letters Patent is hereby corrected as shown below:

Column 8,
Line 33, delete "form" and insert -- from --

Signed and Sealed this

Twenty-fourth Day of May, 2005

JON W. DUDAS
*Director of the United States Patent and Trademark Office*